US005348424A

United States Patent [19]

Tateyama et al.

[11] Patent Number: 5,348,424

[45] Date of Patent: Sep. 20, 1994

[54] REINFORCING BLOCK FOR EXCAVATION WORK AND METHOD OF CONSTRUCTION THEREOF

[75] Inventors: Masaru Tateyama, Kokubunji; Yukihiko Tamura, Yokohama; Kosei Fukuda, Tokyo; Shigeru Yoshida, Tokyo; Chikashi Kami, Tokyo, all of Japan

[73] Assignees: Railway Technical Research Institute; Tokyu Construction Co., Ltd.; Tenox Corp., all of Tokyo, Japan

[21] Appl. No.: 10,148

[22] Filed: Jan. 28, 1993

[30] Foreign Application Priority Data

| | | | |
|---|---|---|---|
| Feb. 7, 1992 | [JP] | Japan | 4-085892 |
| Feb. 10, 1992 | [JP] | Japan | 4-056541 |
| Feb. 10, 1992 | [JP] | Japan | 4-056542 |
| Oct. 20, 1992 | [JP] | Japan | 4-306281 |

[51] Int. Cl.[5] ..... E02D 5/74

[52] U.S. Cl. ..... 405/262; 405/258; 405/240; 405/284

[58] Field of Search ..... 405/262, 266, 267, 239, 405/240, 241

[56] References Cited

U.S. PATENT DOCUMENTS

| | | | |
|---|---|---|---|
| 3,023,585 | 3/1962 | Liver | 405/266 |
| 3,464,216 | 9/1969 | Turzillo | 405/241 X |
| 3,973,409 | 8/1976 | Asayama | 405/262 X |
| 4,036,026 | 7/1977 | Asayama | 405/262 |
| 4,253,781 | 3/1981 | Fischer et al. | 405/266 X |
| 4,906,142 | 3/1990 | Taki et al. | 405/241 X |

OTHER PUBLICATIONS

Encyclopedia of Civil Engineering Methods, pp. 64–65, with English translation, 1988.

*Primary Examiner*—Dennis L. Taylor

*Attorney, Agent, or Firm*—Nikaido, Marmelstein, Murray & Oram

[57] ABSTRACT

A novel method to construct a reinforcing block in an embankment is provided, wherein a core rod to which a protrusion is molded on the tip, is preset inside a hollow rotating shaft with drilling and agitating blades affixed around its circumference, but with the protrusion on the core rod exposed at the front of the shaft. This drilling and agitating shaft rotates and bores into the earth while simultaneously mixing the soil so agitated with a fixing agent; then at a specified depth, the rotating shaft is withdrawn leaving the core rod to remain anchored in the soil while the fixing agent continues to discharge from the end of the hollow rod; and when the hollow rod is completely removed, a reinforcing block is intact within the soil and the tail end of the core rod exposed on the surface of the banking is directly or indirectly affixed to this surface. Alternatively a core rod with no protrusion can be inserted into the hollow rotating shaft which is first drilled into the embankment, such that the nose end of the said core rod is anchored into unagitated soil. In either case the reinforcing block so formed is comprised of an outer concentric tube of agitated soil mixed with a fixing agent molded around an inner concentric tube of reinforcing fixing agent molded around a core rod, and wherein the nose tip of the core penetrates into the unagitated soil beyond the end of the concentric reinforcing layers.

15 Claims, 7 Drawing Sheets

REINFORCING BLOCK FOR EXCAVATION WORK AND METHOD OF CONSTRUCTION THEREOF

BACKGROUND OF THE INVENTION

This invention relates to a reinforcing block to stabilize the ground immediately after excavation, or to reinforce any banking in general, and to a method for construction of said reinforcing block.

In order to prevent excavated slopes from collapsing or to reinforce any banking in general, one conventional method of reinforcement is to drill a large number of small holes, each between 5–10 cm in diameter, into the soil; then fill the holes with grouting material into which steel rods or other reinforcing rods are embedded.

The conventional method as described is not appropriate, nor does it provide adequate reinforcement in all instances, particularly in cases where the soil is loose such as in embankments, or for construction adjacent to sites subject to heavy vibration such as railway tracks. In such cases, the conventional method has some disadvantages. For example, steel rods and similar reinforcement material have a low resistance to expulsive forces, that is, the anchorage stability per unit length of such materials is low, which necessitates the use of many rods, each of extra long length, making the system very expensive.

Alternatively, each hole could be enlarged in order to increase the anchorage stability of the steel rod, but this then destabilizes the surrounding earth. In this case, a disintegration of the soil matrix around even .just a few of the holes would result in a slide; this situation is particularly dangerous for sites around railway tracks.

Moreover, the finished shape of each reinforcing rod is not uniform, making it difficult to determine a safe anchorage force.

SUMMARY OF THE INVENTION

The objective of this invention is to provide a means of resolving these deficiencies by the use of a simple reinforcing block which would safely stabilize the ground without prohibitive cost, and to provide a method for the construction of the said reinforcing block.

This invention is a novel method to construct a reinforcing block in excavated soil, comprising the presetting of a core rod to which a protrusion is molded on the front end, inside a drilling and agitating rod, comprised of a hollow rotating shaft with drilling and agitating blades affixed around its circumference, such that the nose end of the said core rod with the said protrusion is exposed at the nose end of the said hollow rod. The drilling and agitating rod rotates and bores into the earth while simultaneously mixing the soil so agitated with a fixing agent to form an outer layer of stabilized soil; then at a specified depth, the drilling and agitating rod is gradually withdrawn leaving the core rod anchored in the soil while the fixing agent continues to discharge from the end of the hollow rod to form an inner layer of fixing agent enveloping the core rod; and when the hollow rod is completely removed, a reinforcing block is intact within the soil, with the tail end of the core rod exposed on the surface of the banking; this said tail end is directly or indirectly affixed to the said surface.

A preferred embodiment of this invention comprises a core rod to which a screw is molded onto its tip, preset within the hollow rotating shaft.

Another preferred embodiment of this invention comprises a core rod to which a flange type locking plate is molded onto its tip, preset within the hollow rotating shaft.

In a further preferred embodiment of this invention, a drilling and agitating rod, comprised of a hollow rotating shaft with digging and agitating blades affixed around its circumference, rotates and bores into the earth while simultaneously mixing the agitated soil with a fixing agent; then at a specified depth, a core rod is inserted through the center of the hollow rod to a point such that the nose end of the core rod is embedded in the soil, after which the drilling and agitating rod is withdrawn, leaving the core rod to remain in the soil while the fixing agent continues to discharge from the end of the hollow rod; and when the hollow rod is completely removed, the tail end of the core rod exposed on the surface of the embankment is directly or indirectly affixed to the said surface.

In this manner, a novel reinforcing block is formed within the embankment, comprised of an outer concentric tube of agitated soil mixed with a fixing agent molded around an inner concentric tube of reinforcing material molded around a core rod, and wherein the nose tip of the core rod penetrates into the unagitated soil beyond the end of the concentric reinforcing layers.

Thus, the reinforcing block 3 and its construction thereof by the method of this invention provides an effective reinforcement of excavated ground, resolving problems associated with conventional methods.

That is, soil of a specified volume is drilled and agitated and simultaneously, the said agitated earth and a fixing agent are blended and admixed within the excavated soil, hence a reinforcing block of large diameter can be constructed without causing the surrounding soil matrix to disintegrate. The diameter of the reinforcing block is larger than conventional, anchors, enabling a short reinforcing block to be embedded within the soil. This enables the efficient stabilization over a much wider range of the embankment in comparison with conventional methods where a large number of anchors must be constructed in different locations. Moreover, in removing the hollow rod used for digging and agitating the soil, the rotational speed of the rod and its withdrawal speed is suitably adjusted such that the stabilized soil around the reinforcing block will be pushed forward while the hollow rod is being removed. Hence, removal of the rod will not loosen the mixed soil, but rather compacts it to form a very strong reinforcing block.

As well, a core rod is enveloped by a concentric layer of fixing agent of high bending strength, discharged as the hollow agitating rod is removed, leaving the core rod to be firmly bonded to an outer concentric layer of stabilized soil comprised of agitated soil mixed with fixing agent; producing a high quality, highly reliable reinforcing block within the soil. Moreover, in setting the core rod, the nose end of the core rod penetrates into the unagitated soil of the embankment, wherein upon removal of the hollow rod, the said core rod is positioned precisely in the center of the final reinforcing block. Hence the core rod can always be positioned in the center of a reinforcing block of fixed shape.

In addition, using the method of this invention, the soft can virtually be stabilized internally. This means work can safely proceed near railway tracks or roads and buildings, without the danger of cave-ins or slides. As well, the short reinforcing block of large diameter and high reliability makes the method suitable even for narrow construction sites, or sites with height restrictions.

BRIEF DESCRIPTION OF THE DRAWINGS

The invention will be described by examples of the parts used in this method, with reference to the accompanying diagrams, in which.

DETAILED DESCRIPTION OF THE PREFERRED EMBODIMENTS

Figure 1:
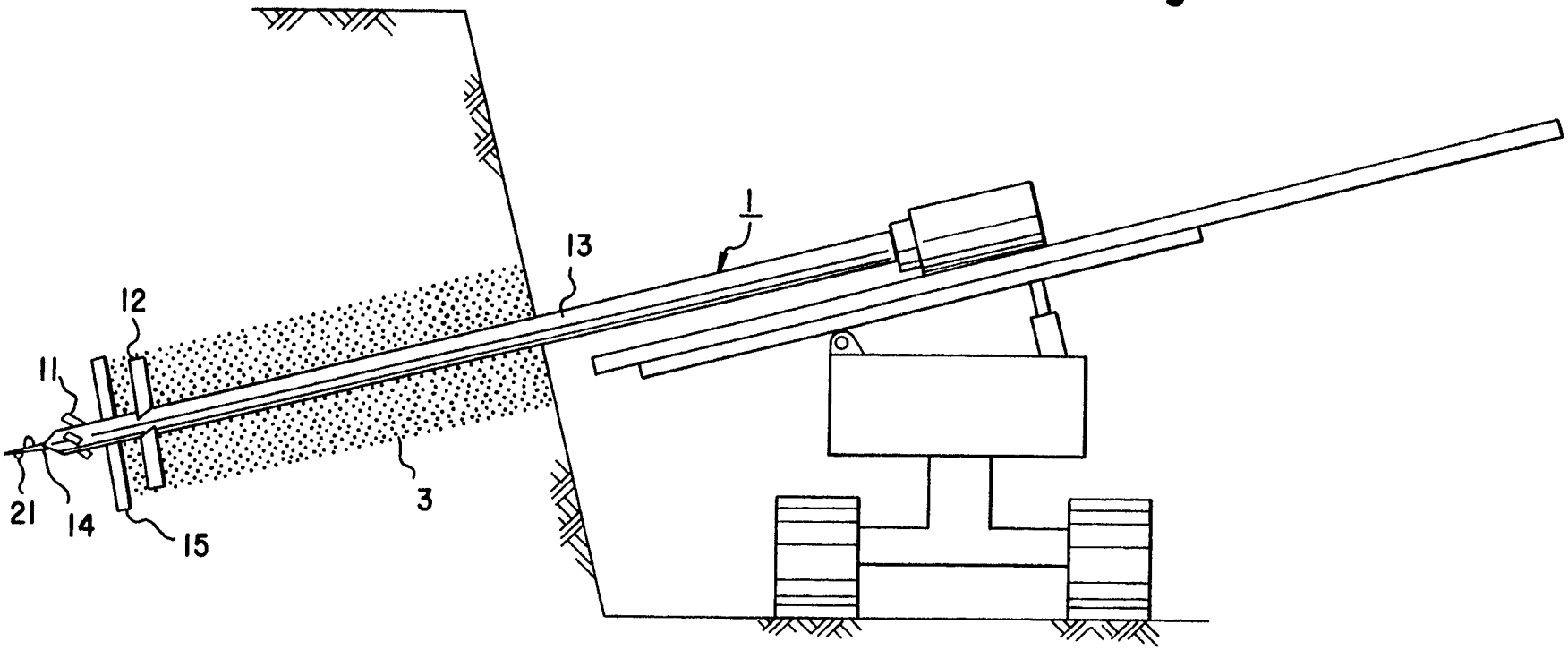
FIG. 1 is an explanatory diagram of one embodiment of the method of this invention to construct a reinforcing block.

The integral parts of this invention will be described first, with reference to FIGS. 1–7.

Drilling and agitating rod

The hollow rod 1 used for drilling into and agitating the soil is a unit comprised of a hollow rotating shaft 13 with drilling blades 11 and agitating blades 12, or one or the other affixed around its circumference at the nose end.

The rotating shaft 13 is molded from a long, hollow pipe. A fixing agent is fed into the rotating shaft 13 from the tail end and passes through the hollow portion of the pipe. Moreover, for those types in which the core rod 2 is to be inserted after the shaft has drilled into the soil, the said core rod is also inserted from the rear and passes through the said shaft 13.

A nose hole 14, allowing passage from the hollow shaft is molded at the nose end of the rotating shaft 13; wherein the said diameter of the hole is just large enough to enable passage of the core rod 2, to be described later. For those configurations in which the core rod 2 is to be inserted after the shaft has drilled into the soil, the hollow portion tapers to form a funnel with the tube of the funnel ending at the nose hole 14 such that the core rod 2 will exit smoothly.

As well, a discharge outlet 16 is molded around the circumference of the nose hole 14 for delivery of the fixing agent passing through the hollow shaft 13 to the soil being agitated as the shaft drills forward.

Drilling Blades and Agitating Blades

Drilling blades 11 are affixed around the circumference at the front end of the hollow rotating shaft 13. These blades cut into the soil as the shaft 13 rotates, effectively agitating the soil. The teeth of the drilling blades 11 can be of a type which is publicly disclosed; for example each blade can be angled in the direction of forward rotation, and can be split into a number of teeth.

The drilling blades 11 not only drill into the soil, but also mix the soil and the hardening agent. And, when the hollow rod is counter rotated for removal from the soil, the angle of the blades will apply pressure to the soil and fixing agent admixture, pushing it forward to settle in place.

Agitating blades 12 are affixed around the circumference of the hollow rotating shaft 13, behind the drilling blades 11, and are comprised of several individual blades, with each blade bent backwards.

A feed plate 15, of a diameter greater than the drilling blades 11 and agitating blades 12, can be inserted to rotate independently between the two said blades. This feed plate 15 is not affixed to the rotating shaft 13, and penetrates into the soil without rotating as the hollow shaft 13 advances. This prevents the soil from revolving in tandem with the rotation of the agitating blades 12.

For the purpose of this document, the operation of the drilling blades 11 and the agitating blades 12 have been explained separately, but in actual usage, the functions of the two blades cannot be systematically separated, and both operate as an integrated unit to drill and mix.

Core

The core of the reinforcing block can be set in several configurations as follows.

1. Core rod with attached screw is preset inside hollow shaft

Figure 2:
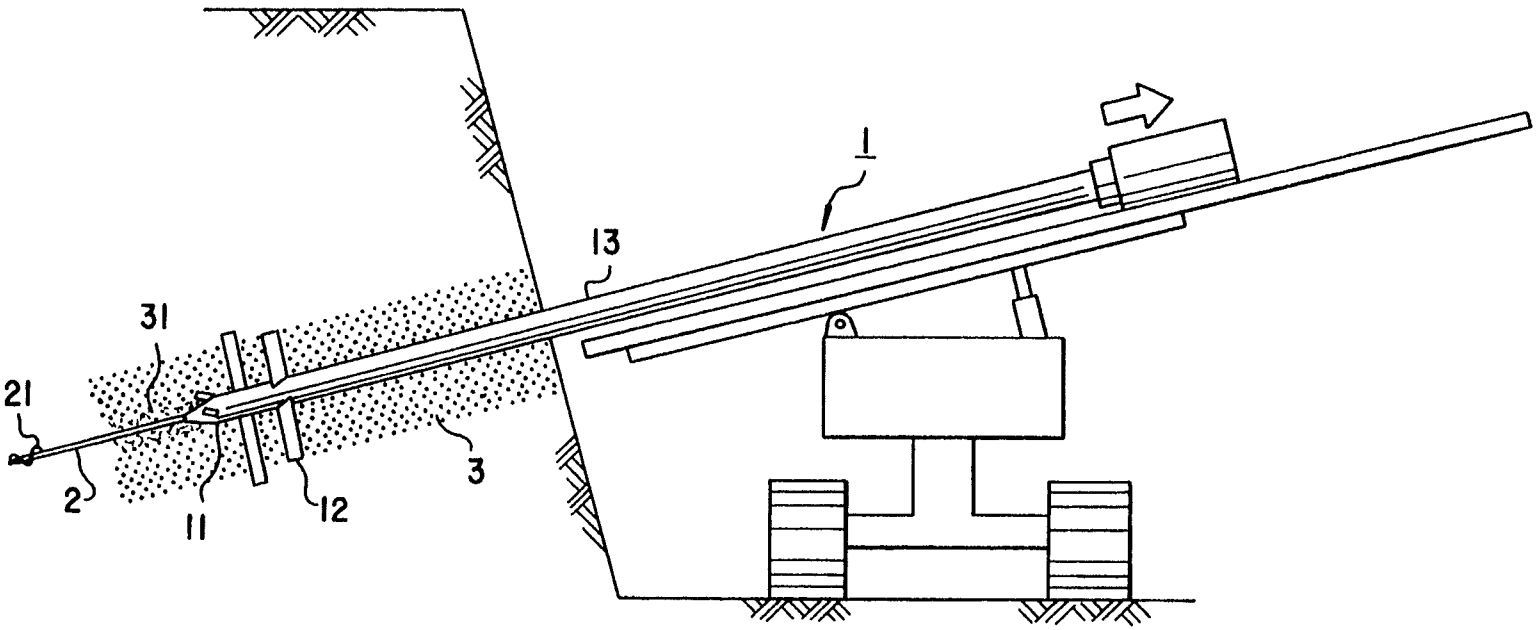
FIG. 2 is an explanatory diagram of another phase of the embodiment of the method of this invention as shown in FIG. 1.
Figure 3:
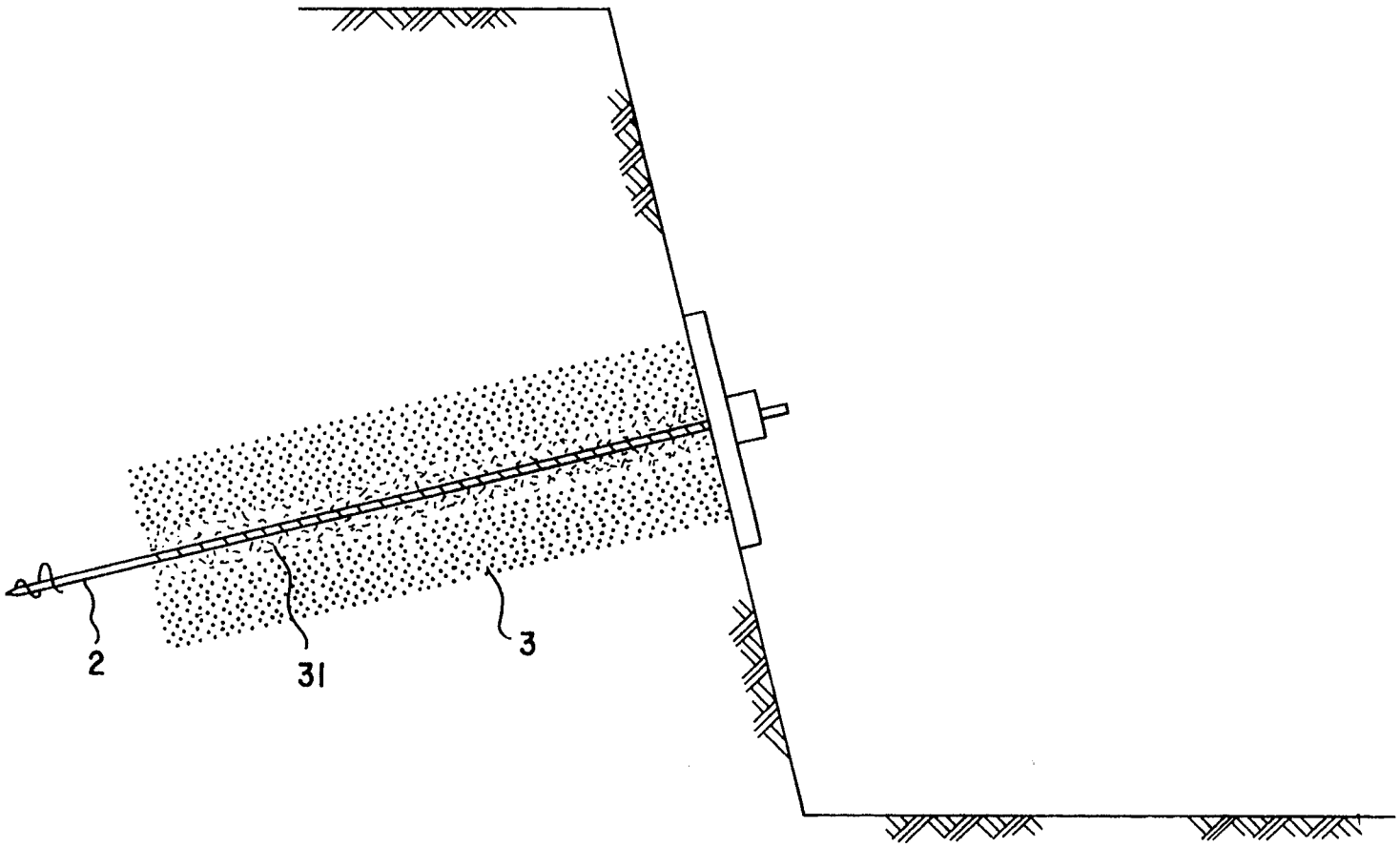
FIG. 3 is an explanatory diagram of a further phase of the embodiment of the method of this invention as shown in FIG. 1.

FIGS. 1–3 show an embodiment of the core in which the core 2 is a rod with a screw 21 molded onto its tip. The rod should preferably be a reinforcement, fiber reinforced plastic, carbon, steel pipe, or similar rod of high bending strength, durability, and rust-resistance.

In this configuration, the core 2 is preset within the hollow portion of the hollow rotating shaft, 13, such that the screw 21 is exposed at the end of the said shaft.

The core 2 is set to receive the rotational force of the rotating shaft 13, and as such rotates in tandem with the said shaft. Thus, the screw 21 bores into the soil ahead of the rotating shaft 21.

2. Core rod with attached locking plate is preset inside hollow shaft

Figure 6:
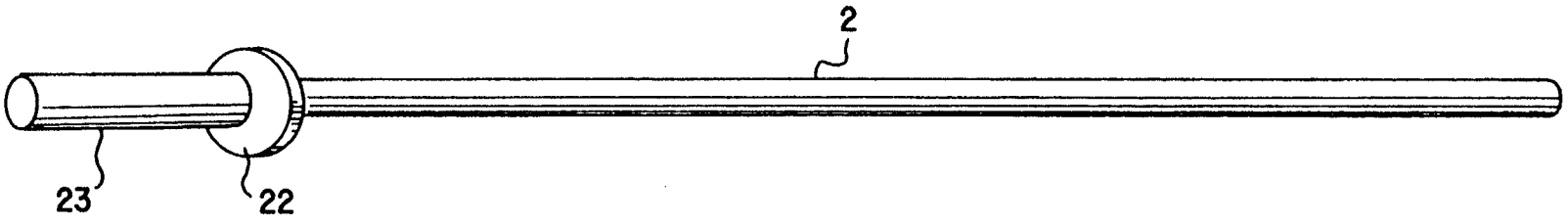
FIG. 6 is an explanatory diagram of one embodiment of the core rod.
Figure 7:
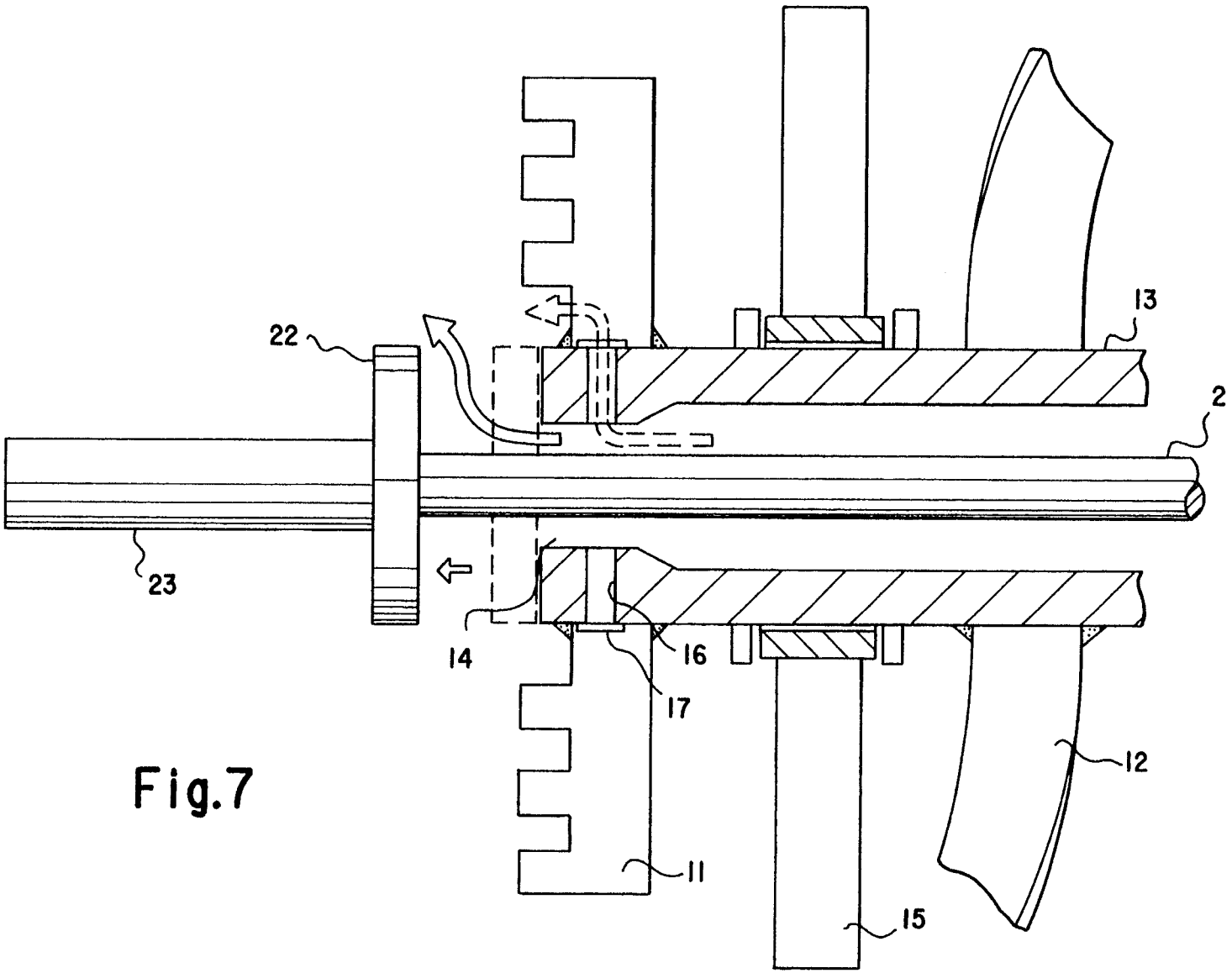
FIG. 7 is an explanatory diagram of the configuration of the end of the rotating shaft.

FIGS. 6 and 7 show another embodiment of the core of the reinforcing block. Instead of screw 21, a circular flange to function as a locking plate 22 is molded on the end of the core rod 2. The said rod should preferably be a steel, fiber reinforced plastic, carbon, copper, or similar rod of high bending strength, durability, and rust-resistance.

This locking plate 22 is of a dimension and shape which will completely cover from the outside the nose hole 14 on the tip of the rotating shaft 13, and in general, is slightly larger in diameter than the core rod 2. The said locking plate is welded, glued, clad, or otherwise firmly affixed to the said core rod.

The locking plate 22 is separated from the nose hole 14 only upon removal of the rotating shaft, and cannot be expelled forward during drilling.

An anchoring shaft 23, in the shape of a cone, cylinder, or other shape, is molded in front of the locking plate 22. This anchoring shaft 23 penetrates into the unagitated soil ahead of the rotating shaft, which will prevent the core rod 2 from being pulled along and removed with the hollow rod 1 during its removal.

3. Core rod with no protrusion is post-inserted into hollow shaft

Figure 4:
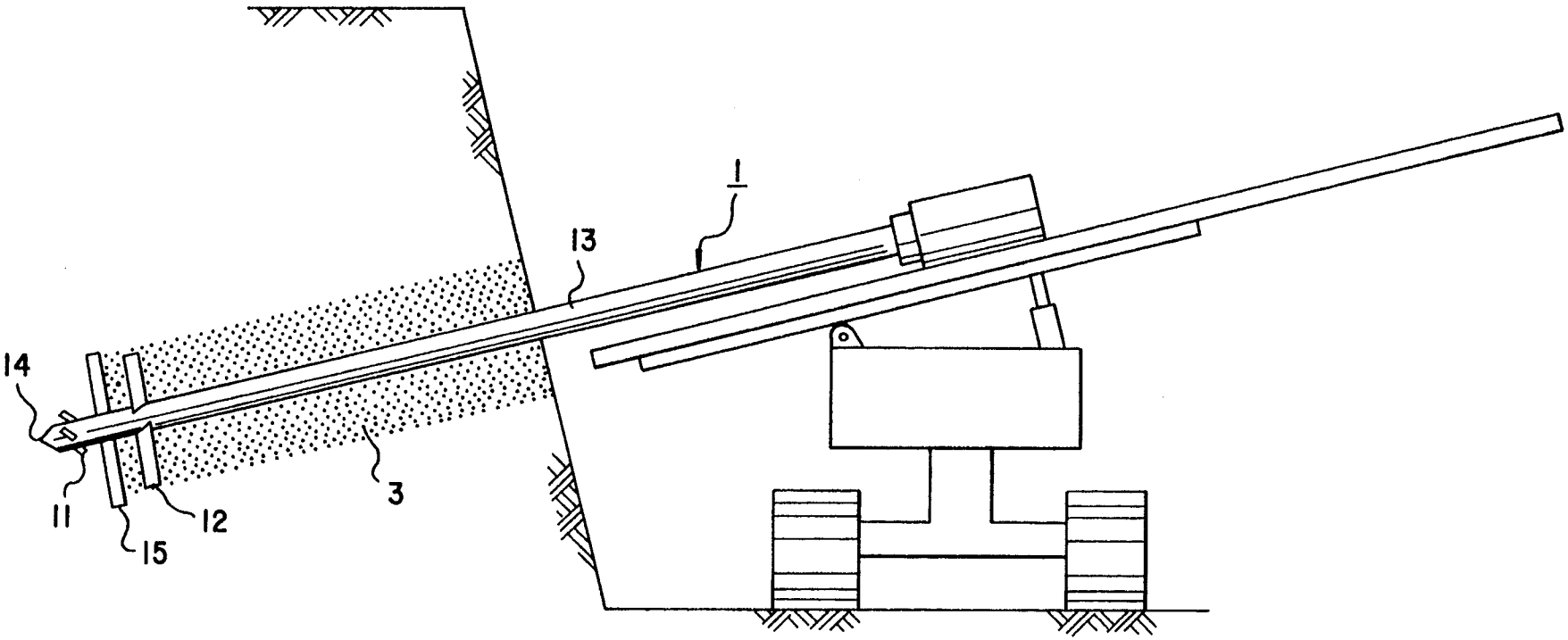
FIG. 4 is an explanatory diagram of another embodiment of the method of this invention to construct a reinforcing block.
Figure 5:
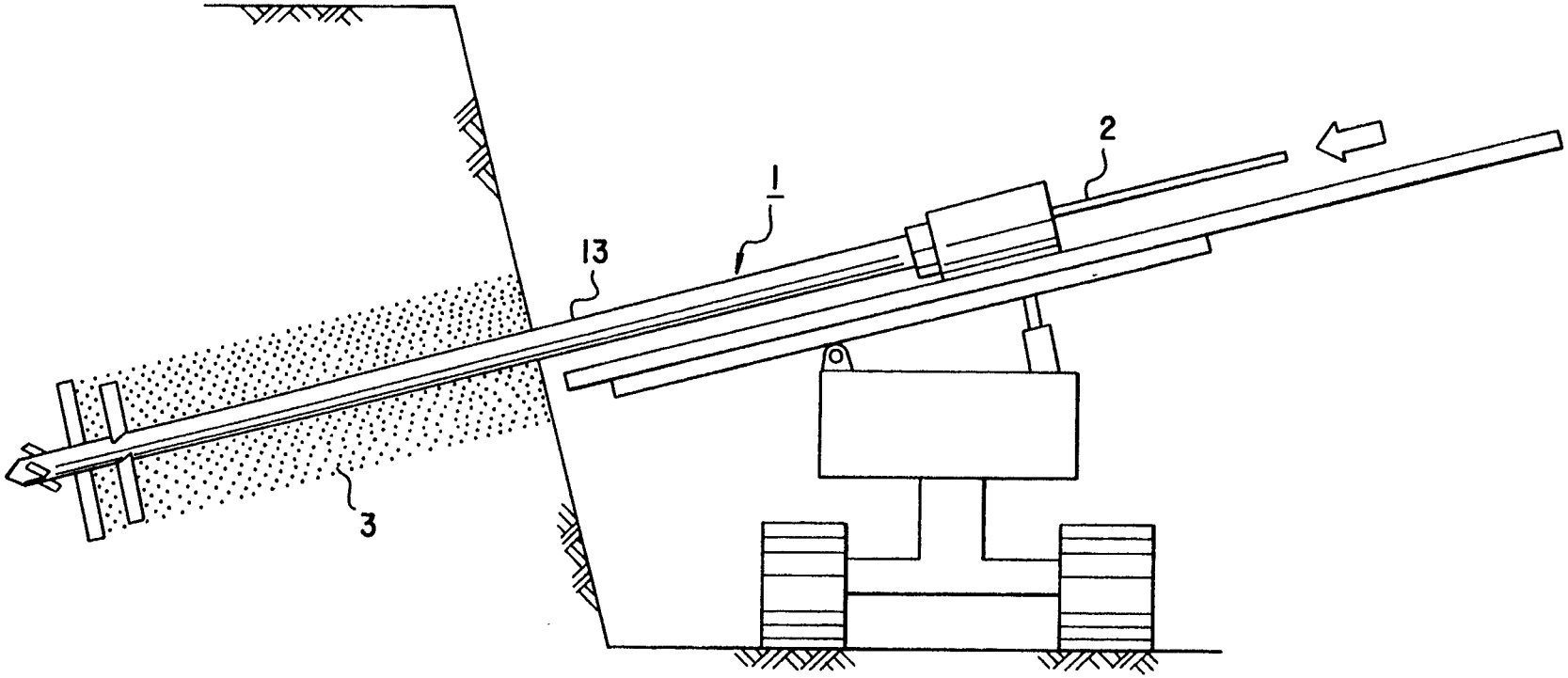
FIG. 5 is an explanatory diagram of another phase of the embodiment of the method of this invention as shown in FIG. 4.

FIGS. 4 and 5 show a further embodiment of the core of the reinforcing block, wherein no protrusion is molded onto the tip of the core rod 2. The said rod should preferably be a steel, fiber reinforced plastic, carbon, copper, or other rod of high bending strength, durability, and rust resistance.

As will be described later, this configuration is used where the hollow rotating shaft 13 first drills into the earth after which the core rod 2 is inserted from the tail end of the hollow shaft and pushed through the shaft to a point where the core rod penetrates into the unagitated soil.

Steps involved in the deployment of the parts of this invention as described above are explained next, again with reference to the accompanying figures.

A. Setting the core rod inside the excavated soil

1. Core rod with attached screw is preset inside hollow shaft

FIGS. 1–3 show one embodiment of the method of this invention to construct a reinforcing block, comprising the screw 21 molded onto the front end of the core rod 2 which is then preset into the rotating shaft 13. A rotational force and a propulsive force or a pushing force is applied to the hollow rod 1, whereby the drilling blades 11 affixed to said hollow rod 1 bore into the soil and the shaft advances forward. With this action, a fixing agent is emitted from a discharge outlet 16 located near the front end of the rotating shaft 13. The said fixing agent can be cement milk, mortar, or any similar fixing material in liquid or powder form. The said discharge outlet 16 is covered with a check valve 17, hence soil cannot penetrate back into the delivery passage.

The rotating shaft 13 is rotating concurrently with delivery of the fixing agent, whereby the agitating blades 12 will mix the said fixing agent with the soil being dug by the drilling blades 11; whereupon a reinforcing block 3 of large diameter, comprised of a composite of the soil and the cement milk or other fixing agent will be formed inside the soil. Rotation of the rotating shaft 13 ceases when drilling and mixing is completed to the deepest depth.

In this case, the screw 21, molded onto the end of the core rod 2, becomes embedded in the unagitated ground. This enables the core rod 2 to be fixed into the soil to a depth beyond the stabilized soil.

2. Core rod with attached locking plate is preset inside hollow shaft

In another embodiment of the method of this invention, the core rod configuration of FIG. 6 is used; otherwise the core rod is set into the excavated soil in a manner similar to that for a core rod with an attached screw. In this case, the anchoring shaft 23 penetrates into the unagitated soil. The locking plate 22, positioned behind the fixed shaft 23, becomes embedded within the said soil, thus firmly anchoring the core rod 2 into the said soil, and acting to resist its removal.

3. Core rod with no protrusion is post-inserted into hollow shaft

FIGS. 4 and 5 illustrate a further embodiment of the method of this invention, comprising the use of a core rod 2 with no protrusion molded onto its tip. In this case, rotation of the rotating shaft 13 ceases when the hollow rod 1 advances to a specified depth, at which point the core rod 2 is inserted from the tail end of the rotating shaft 13.

The nose hole 14 on the front end of the hollow rod 1 is covered with a lid which is pushed outward by the inserted core rod 2; when the nose end of the said core rod is exposed at the front end of the hollow rod 1, the tail end of the said core rod is hammered or otherwise suitably pushed inwards, whereby the core rod 2 will penetrate into and be firmly fixed in the unagitated soil.

B. Removal of hollow rod

Once the core rod 2 of any of the above-mentioned embodiments is set in the soil, the hollow rod I is gradually withdrawn, leaving the said core rod to remain in the soil.

For this, the rotating shaft 13 is counter rotated and the shaft revolution and the speed of withdrawal are each adjusted to an optimal speed such that the stabilized soil, comprised of the agitated soil and fixing agent, which will form part of the reinforcing block 3 is pushed forward while the hollow rod 1 is removed.

However, counter rotation of the hollow rod 1 is not an essential condition for its removal. Configurations in which the drilling and agitating blades are not tilted can be removed without any counter rotation.

Since the nose end of the core rod 2, which had been positioned in the center of the rotating shaft 13, has penetrated into the unagitated soil of the embankment, the hollow rod 1 can be removed while leaving the core rod 2 accurately intact in the center of the reinforcing block 3 to be ultimately formed.

C. Discharge of fixing agent

In removing the hollow rod 1, a cavity is formed as soil in an amount equal to the volume of the rotating shaft 13 has been displaced; wherein if the cavity is not refilled, the surrounding soil will crumble. Hence, while the said hollow rod 1 is being withdrawn, cement milk, mortar, or other similar fixing agent continues to discharge from the discharge outlet 16 near the front end of the rod to replace the displaced soil, filling the cavity around the core rod.

This concentric layer of fixing agent discharged with removal of the hollow rod is not mixed with any soil, effectively forming an inner concentric reinforcing tube 31 of high quality fixing agent without much admixed soil, to envelop the circumference of the core rod 2.

D. Anchoring of tail end of core rod

Once the hollow rod 1 is completely withdrawn from the embankment, the tail end of the core rod 2, which has been reinforced around its circumference, is exposed at the surface of the embankment. This said tail end is fixed to either a load-bearing plate, the concrete wall to be constructed later, a temporary dike, or other frame to be constructed on the face of the said embankment.

In certain situations, the tail end of the core rod 2 can be clamped and pulled with a jack, and function as an anchor of specific tensile strength.

Figure 8:
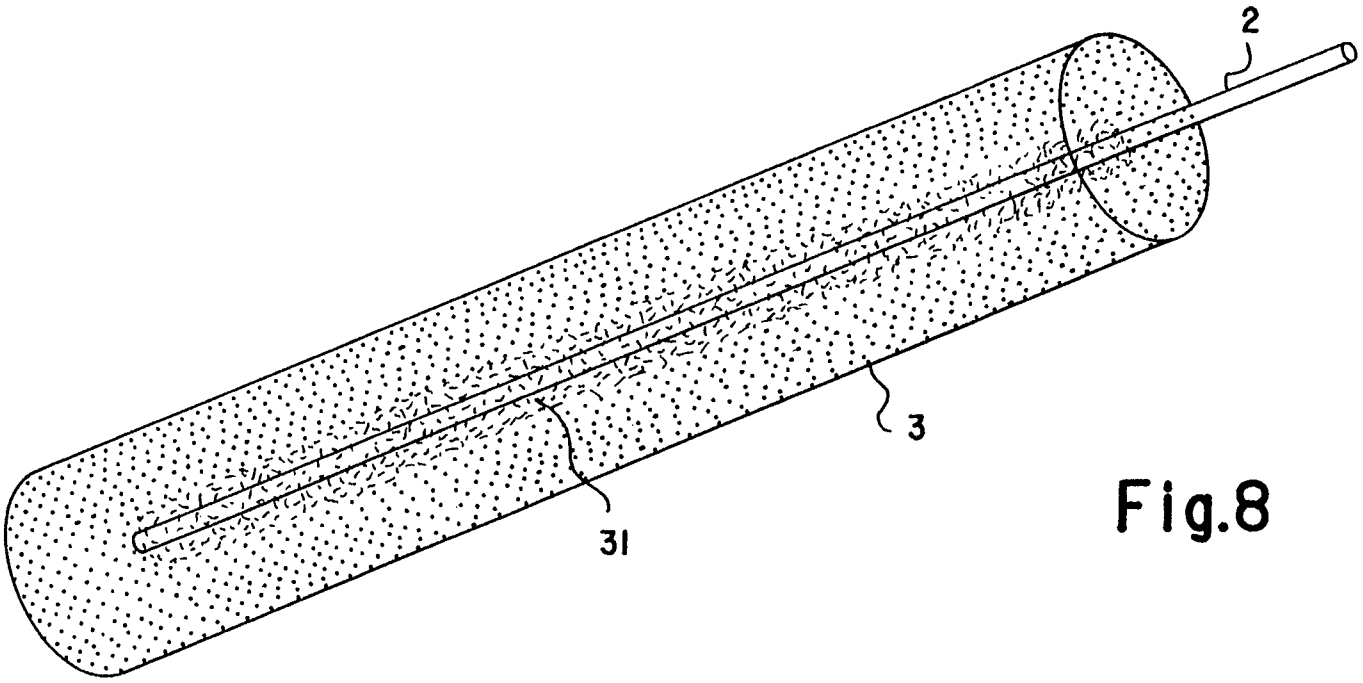
FIG. 8 is an explanatory diagram of one embodiment of the reinforcing block produced by the method of this invention.

FIG. 8 illustrates the reinforcing block 3 ultimately formed by deployment of the parts of this invention in accordance with the method described above. A core rod 2, preferably a reinforcement, fiber reinforced plastic, carbon, steel pipe, or other rod of high bending strength, durability, and rust resistance is enveloped by an inner concentric reinforcing layer comprised of a high bending strength fixing agent, preferably cement milk, mortar, or any similar fixing material and further reinforced by an outer concentric layer of admixed soil and said fixing agent.

What is claimed is:

1. A method of stabilizing ground comprising a ground surface, which comprises:

providing a boring tool comprising:

a substantially open ended hollow shaft means having a first end adapted to be directed toward the ground and a second end remote therefrom;

ground cutting means of a first diameter on said hollow shaft means proximate to said first end;

ground mixing means, of a larger diameter than the diameter of said cutting means, on said shaft means disposed between said cutting means and said second end;

rod means adapted to be disposed through said hollow shaft means, which rod means comprises a first end which is adapted to extend through said first end of said hollow shaft means, a second end remote therefrom, and screw means on said first end of said rod means adapted to extend through said first end of said hollow shaft means into engaging relationship with said ground;

means to turn said hollow shaft means;

means to turn said rod means; and means to supply fixing means into said hollow shaft means; said method comprising:

positioning said boring tool on said ground;

turning and thereby driving said hollow shaft means into said ground, under conditions sufficient to cause said ground cutting means to form a hole in said ground, and said mixing means to agitate the ground around said hollow shaft means, for a time sufficient to form a hole in said ground of a predetermined depth;

during the forming of said hole in said ground, passing said fixing composition through said hollow shaft means and out said first end into admixture with said agitated ground, thereby forming an outer column comprising a mixture of agitated ground and fixing material about said hollow shaft means;

passing said rod means through said hollow shaft means and screwing said screw means into said ground at the bottom of said hole;

while leaving said rod screwed into said ground at the bottom of said hole, extricating said hollow shaft means from said hole while passing additional fixing composition through said first end around said rod in an amount sufficient to form an intermediate column comprising predominantly fixing agent about said rod, and substantially within said outer column;

setting up said fixing material; and connecting said rod second end to said ground

2. A method in accordance with claim 1 wherein said rod means has a screw molded on its first end.

3. A method in accordance with claim 1 wherein said rod means has a flange locking plate molded on

4. A method as claimed in claim 1 wherein said ground is an embankment.

5. An anchor in a hole in ground comprising:

rod means having a first end directed toward a bottom of a hole in said ground and a second end remote therefrom;

screw means disposed on said rod first end firmly affixed to ground in the bottom of said hole;

an intermediate column comprising substantially only set up fixing material disposed about, and in binding relation to, said rod means;

an outer column comprising a mixture of set up fixing material and cut up ground dispersed therein disposed about and in binding relation to said intermediate column; and means to tie said second end of said rod means to the surface of said ground outside said hole.

6. An anchor as claimed in claim 5 wherein a first end of said intermediate column protrudes past said outer column and penetrates into unagitated soil beyond the outer concentric column.

7. An anchor as claimed in claim 5, in which the core material is a steel rod.

8. A reinforcing block as claimed in claim 6, in the core material is a steel rod.

9. An anchor as claimed in claim 5, in which the core material is a carbon fiber rod.

10. An anchor as claimed in claim 5, in which the core material is a fiber reinforced plastic rod.

11. An apparatus, for drilling a hole in ground and forming an anchor through said hole and into ground at the bottom of said hole, which comprises:

a hollow shaft means having a first end directed toward the bottom of said hole and a second end directed away from the bottom of said hole, which second end is disposed above said ground, wherein the hollow portion of said shaft is adapted to communicate between above the ground and the bottom of said hole;

ground cutting means on said shaft of a first effective diameter disposed proximate to said first end of said shaft and adapted to cut ground at the bottom of said hole and to thereby make and deepen said hole;

agitating means of a second effective diameter, larger than said first effective diameter, disposed on said shaft proximate to said first end of said shaft between said ground cutting means and said shaft second end;

core rod means adapted to be disposed in and through said hollow shaft means having a first end adapted to extend through said first end of said hollow shaft means further into said ground than said first end of said hollow shaft means, and having a second end adapted to be extended through said second end of said hollow shaft means to a position which is adapted to be affixed to the surface of said ground;

screw, means disposed proximate to said core rod first end adapted to penetrate said ground;

means to turn and drive said hollow shaft means and to thereby drive and turn said ground cutting means, and said agitating means, whereby to force said ground cutting means to cut said ground in said hole, and to cause said agitating means to agitate the ground around said hollow shaft means, a diameter larger than the diameter of said ground cutting means;

means, operating during the driving of said hollow shaft means into the ground and during extrication of said hollow shaft means from said hole in said ground, to supply fixing material into said hollow shaft means and out a hole in said first end of said hollow shaft means;

means to dispose said rod means through said hollow shaft means and to screw said screw means into said ground at the bottom of said hole;

means, operative during the driving of said hollow shaft means into the ground, to eject fixing material from said first end of said hollow shaft means into admixture with said agitated cut ground about said hollow shaft means proximate to said agitating means, whereby to mix said fixing means with said ground cuttings and agitated ground about said hollow shaft means;

means, operative after said hollow shaft means has bored a hole to a predetermined depth and said screw means has penetrated said ground at the bottom of said hole at said predetermined depth and became anchored thereinto, to stop the pentration of said hollow shaft means into said ground;

means, operative after said hole has been bored to said predetermined depth, to extricate said hollow shaft means from said hole while leaving said core rod anchored in said ground through said screw means;

means, operative during said extrication of said hollow shaft means from said hole, to eject fixing material from said first end of said hollow shaft means about said core rod means whereby forming an intermediate column, comprising substantially only fixing material, about said core rod, and an outer column, comprising a mixture of fixing material and agitated ground, surrounding said intermediate column;

means to set up said fixing material; and means to affix said second end of said core rod means to the surface of said ground.

12. An apparatus as claimed in claim 11 wherein said core rod means is disposed in and through said hollow shaft means during the penetration of said hollow shaft means into said ground.

13. An apparatus as claimed in claim 12 wherein said core rod means comprises steel.

14. An apparatus as claimed in claim 12 wherein said core rod means comprises carbon fiber.

15. An apparatus as claimed in claim 12 wherein said core rod means comprises fiber reinforced plastic.

* * * * *